US005472536A

United States Patent [19]

Doris et al.

[11] Patent Number: 5,472,536

[45] Date of Patent: Dec. 5, 1995

[54] TRACER MIXTURE FOR USE WITH LASER HARDENED OPTICS

[75] Inventors: Thomas A. Doris, Sparta, N.J.; Raymond Martin, Tallahassee, Fla.

[73] Assignee: The United States of America as represented by the Secretary of the Army, Washington, D.C.

[21] Appl. No.: 358,290

[22] Filed: Dec. 19, 1994

[51] Int. Cl.[6] ..... C06B 33/14

[52] U.S. Cl. ..... 149/41; 149/42; 149/43; 149/77; 149/108.2; 149/123

[58] Field of Search ..... 149/42, 41, 43, 149/70, 77, 108.2, 123

[56] References Cited

U.S. PATENT DOCUMENTS

| | | | |
|---|---|---|---|
| 3,761,329 | 9/1973 | Zilcosky | 149/19.91 |
| 3,983,816 | 10/1976 | Cornia et al. | 149/43 X |
| 4,000,022 | 12/1976 | Beckert et al. | 149/37 X |
| 4,094,711 | 9/1977 | Ramnarace | 149/43 X |
| 4,438,700 | 3/1984 | Knapp | 149/41 X |
| 4,696,705 | 9/1987 | Hamilton | 149/41 X |
| 4,698,107 | 10/1987 | Goetz et al. | 149/41 X |
| 4,979,999 | 12/1990 | Briere | 149/43 X |
| 5,042,386 | 8/1991 | Kruse et al. | 149/11 X |

*Primary Examiner*—Peter A. Nelson
*Attorney, Agent, or Firm*—Anthony T. Lane; Edward Goldberg; John E. Callaghan

[57] ABSTRACT

A pyrotechnic mixture for use in tracer rounds of projectiles to increase visibility under high speed conditions when viewed through laser hardened optics, comprising, in percentages by weight, an admixture of 20% to 40% magnesium, 10% to 30% strontium nitrate, 3% to 8% sodium nitrate, 3% to 20% barium peroxide and 1% to 5% viton. Additional ingredients that increase the pyrotechnic effectiveness are 0% to 5% aluminum, 0% to 15% potassium perchlorate, 0% to 5% manganese dioxide, 0% to 10% iron oxide as $Fe_2O_3$, 0% to 15% potassium nitrate, 0% to 10% Teflon and 0% to 1% ethyl cellulose.

8 Claims, No Drawings

TRACER MIXTURE FOR USE WITH LASER HARDENED OPTICS

The invention described herein may be made, used, or licensed by or for the Government for Governmental purposes without the payment to me of any royalties thereon or therefor.

FIELD OF THE INVENTION

The present invention relates to a tracer round of ammunition. More particularly the invention relates to an improved tracer round of relatively small size and high velocity that produces an improved tracer trail of much greater visibility, particularly when viewed through laser hardened optics.

BACKGROUND OF THE INVENTION

Tracer rounds have been included in multiple firing guns almost as a standard. Because of the significant aid that tracer rounds provide in adjusting the path of projectile travel toward the intended target, tracer rounds are included in almost every rapid fire armament ammunition.

The function of the tracer round is to produce a representation of the path of the projectile that is visible to the operator of the gun in order to allow the operator to adjust the path and reach the target. Depending upon the frequency of firing, the percentage of tracer rounds in the total number of rounds will vary, from a very high percentage when very short bursts are fired or if firing is 'semiautomatic' rather than fully automatic, to a somewhat lower percentage when firing long bursts of large numbers of rounds. In any case it is necessary for the operator or an observer reporting to the operator to see the tracer round.

One example of a conventional tracer round is shown in U.S. Pat. No. 3,633,512, to Schlack et al. In this design, a tracer mix is incorporated into the tracer cavity of a self destructive projectile such that there is a forward high explosive cavity and a rearward tracer cavity. The round has become typical of conventional usage of tracer designs since its development in the 1970's.

In prior art designs, when increased visibility of the tracer round was desired, it was usually accomplished simply by increasing the diameter of the tracer column to provide a larger cross sectional area. This adjustment provides a larger viewing surface and hence greater visibility.

Modern projectiles have evolved, however, in ways that do not permit the old methods to resolve visibility problems. For example, the 25 mm M919 round is a high velocity, maximum range round that is being developed for various applications such as the Bradley Fighting Vehicle and other uses. It is a 25 mm round that is approximately the size of the pencil. Because of its range and speed, the tracer round is difficult to see.

Another technical advance that has caused difficulty for tracer rounds is the use of laser hardened optics and thermal viewers. As lasers are being considered for aiming devices and even for defensive measures, it has become important to shield the eyes of the observer from laser radiation. Techniques are available to accomplish that goal but in so protecting the eyes of the observer, visibility particularly of tracer rounds for fast and long range projectiles has decreased. In the case of the M919, for example, the tracer round cannot be seen through the most preferred laser hardened optics and the thermal viewer.

Prior art methods described above for increasing the cross sectional area were not available due to the configuration of the round, mainly in the diameter and other dimensions. For that reason, it is an object of this invention to provide a way to increase the visibility of tracer rounds through laser hardened optics and thermal viewers.

Another object is to provide an improved pyrotechnic mixture that can be used in tracer rounds to increase visibility of the tracer round while avoiding mechanical alteration or design changes.

Other objects will appear hereinafter.

SUMMARY OF THE INVENTION

It has now been discovered that the above and other objects of the present invention may be accomplished in the following manner. Specifically, the invention comprises an improved pyrotechnic mixture for use in tracer rounds of projectiles to increase visibility under high speed conditions when viewed through laser hardened optics.

The pyrotechnic mixture of the present invention includes, in percentages by weight, an admixture of 20% to 40% magnesium, 10% to 30% strontium nitrate, 3% to 8% sodium nitrate, 3% to 20% barium peroxide and 1% to 5% viton.

In a preferred embodiment, additional ingredients that increase the pyrotechnic effectiveness are 0% to 5% aluminum, 0% to 15% potassium perchlorate, 0% to 5% manganese dioxide, 0% to 10% iron oxide as $Fe_2O_3$, 0% to 15% potassium nitrate, 0% to 10% Teflon and 0% to 1% ethyl cellulose. Variations on these compositions provide substantially improved tracer rounds with suitable visibility when viewed through laser hardened optics and a thermal viewer.

DETAILED DESCRIPTION OF THE PREFERRED EMBODIMENT

The present invention comprises a pyrotechnic mixture for use in tracer rounds of projectiles and includes a plurality of components. The compositions of this invention not only provide increased luminous output, but the output has been found to be the appropriate spectral areas that are not filtered out by laser hardened optics. The compositions of the present invention also include components that enhance emmitance in those areas of the infra-red spectrum that allows the tracer to be viewed by thermal devices.

The pyrotechnic mixture of the present invention produces increased visibility under high speed conditions for tracer round projectiles when viewed through laser hardened optics. The mixtures are formed by conventional admixing techniques where pyrotechnic materials are handled, using appropriate industrial standards of safety and protection from inadvertent detonation. In all cases herein, the compositions are listed in percentages by weight, based upon the weight of the total pyrotechnic mixture.

The preferred pyrotechnic mixture of this invention includes 20% to 40% magnesium, 10% to 30% strontium nitrate, 3% to 8% sodium nitrate and 1% to 5% viton. Additionally the mixture may include 0% to 5% aluminum, 0% to 15% potassium perchlorate, 0% to 5% manganese dioxide, 0% to 10% iron oxide as $Fe_2O_3$, 0% to 20% barium peroxide, 0% to 10% polyvinyl chloride, 0% to 15% potassium nitrate, 0% to 10% Teflon and 0% to 1% ethyl cellulose.

In testing various combinations of the above pyrotechnic mixtures, the following combinations have been found to be effective in 25 mm rounds and smaller.

| Percent by Weight | Component |
|---|---|
| | Mixture A |
| 40% | magnesium |
| 20% | strontium nitrate |
| 5% | sodium nitrate |
| 5% | viton |
| 5% | manganese dioxide |
| 9% | iron oxide as $Fe_2O_3$ |
| 15% | potassium nitrate |
| 1% | ethyl cellulose. |
| | Mixture B |
| 35% | magnesium |
| 20% | strontium nitrate |
| 5% | sodium nitrate |
| 10% | barium peroxide |
| 5% | viton |
| 5% | aluminum |
| 5% | manganese dioxide |
| 5% | potassium nitrate |
| | MIXTURE C |
| 40% | magnesium |
| 20% | strontium nitrate |
| 5% | sodium nitrate |
| 5% | viton |
| 5% | polyvinyl chloride |
| 10% | barium peroxide |
| 15% | potassium perchlorate |

While particular embodiments of the present invention have been illustrated and described herein, it is not intended that these illustrations and descriptions limit the invention. Changes and modifications may be made herein without departing from the scope and spirit of the following claims.

We claim:

1. A pyrotechnic mixture for use in tracer rounds of projectiles to increase visibility under high speed conditions when viewed through laser hardened optics, comprising, in percentages by weight:

an admixture of 20% to 40% magnesium, 10% to 30% strontium nitrate, 3% to 8% sodium nitrate, 3% to 20% barium peroxide and 1% to 5% viton.

2. The mixture of claim 1, which further includes in said admixture, in percentages by weight one of the following:

0% to 5% aluminum, 0% to 15% potassium perchlorate, 0% to 5% manganese dioxide, 0% to 10% iron oxide as $Fe_2O_3$, 0% to 15% barium peroxide, 0% to 10% polyvinyl chloride, 0% to 15% potassium nitrate, 0% to 10% Teflon and 0% to 1% ethyl cellulose.

3. The mixture of claim 2, comprising:

40% magnesium,
20% strontium nitrate,
5% sodium nitrate,
5% viton,
5% manganese dioxide,
9% iron oxide as $Fe_2O_3$,
15% potassium nitrate, and
1% ethyl cellulose.

4. The mixture of claim 2, comprising:

35% magnesium,
20% strontium nitrate,
5% sodium nitrate,
10% barium peroxide
5% viton,
5% aluminum,
5% manganese dioxide, and
5% potassium nitrate.

5. The mixture of claim 2, comprising:

40% magnesium,
20% strontium nitrate,
5% sodium nitrate,
5% viton,
5% polyvinyl chloride,
10% barium peroxide, and
15% potassium perchlorate.

6. The mixture of claim 1, incorporated in a tracer round of 25 mm or smaller.

7. A pyrotechnic mixture for use in tracer rounds of projectiles to increase visibility under high speed conditions when viewed through laser hardened optics, comprising, in percentages by weight:

an admixture of 20% to 40% magnesium, 10%. to 30% strontium nitrate, 3% to 8% sodium nitrate, 3% to 20% barium peroxide and 1% to 5% viton, 0% to 5% aluminum, 0% to 15% potassium perchlorate, 0% to 5% manganese dioxide, 0% to 10% iron oxide as $Fe_2O_3$, 0% to 15% potassium nitrate, 0% to 10% Teflon and 0% to 1% ethyl cellulose.

8. The mixture of claim 7, incorporated in a tracer round of 25 mm or smaller.

* * * * *